US005636567A

United States Patent [19]

Mucha et al.

[11] Patent Number: 5,636,567

[45] Date of Patent: Jun. 10, 1997

[54] PRINTING PRESS WITH WEB FEED METERING SYSTEM

[75] Inventors: Timothy J. Mucha, Coconut Creek; Robert Manzella, North Lauderdale, both of Fla.

[73] Assignee: Webtron Corporation, Ft. Lauderdale, Fla.

[21] Appl. No.: 657,814

[22] Filed: May 31, 1996

[51] Int. Cl.[6] ..... B41F 5/04; B41F 13/12; B41F 13/008

[52] U.S. Cl. ..... 101/181; 101/228

[58] Field of Search ..... 101/181, 183–185, 101/178, 179, 182, 136, 137, 138–140, 141–145, 228, 227

[56] References Cited

U.S. PATENT DOCUMENTS

| | | | |
|---|---|---|---|
| 3,594,552 | 7/1971 | Adamson et al. . | |
| 4,177,430 | 12/1979 | Schriber et al. | 10/228 |
| 4,452,140 | 6/1984 | Isherwood et al. . | |
| 4,541,335 | 9/1985 | Tokuno et al. . | |
| 4,646,363 | 3/1987 | Gertsch . | |
| 4,722,275 | 2/1988 | Taguchi et al. . | |
| 5,213,037 | 5/1993 | Leopardi, II . | |
| 5,269,222 | 12/1993 | Johnson et al. . | |

*Primary Examiner*—J. Reed Fisher

*Attorney, Agent, or Firm*—Hovey, Williams, Timmons & Collins

[57] ABSTRACT

A web printing press is provided with a plurality of printing units, each including a plate cylinder, an idling impression cylinder, and web metering roller supported between the side walls of a frame. A motor-driven primary line shaft is supported on the frame and extends along one of the side walls, and a first gearbox is connected between the primary line shaft and the plate cylinder of each unit for transmitting rotation of the primary line shaft to the plate cylinder. A second gearbox is connected between the primary line shaft and the web metering roller of each unit for transmitting rotation of the primary line shaft to the web metering roller. A motor-driven secondary line shaft is supported on the frame and extends along one of the side walls adjacent the primary line shaft, and the second gearbox of each printing unit includes gearing connected to the secondary line shaft for trimming the speed of the web metering roller relative to the speed of the primary line shaft upon rotation of the secondary line shaft.

9 Claims, 1 Drawing Sheet

PRINTING PRESS WITH WEB FEED METERING SYSTEM

BACKGROUND OF THE INVENTION

1. Field of the Invention

The present invention relates generally to the art of rotary web printing, and more particularly to a web printing press having a web metering system for controlling the speed of a web through the press.

2. Discussion of the Prior Art

Flexographic web printing presses are conventionally used in the printing of a wide variety of materials such as packaging and the like, and typically include a plurality of printing units, each provided with a flexographic plate cylinder, an impression cylinder opposing the plate cylinder to form a printing nip, and an inking assembly including an anilox roller for inking the plate cylinder. In addition, conventional presses may include downstream web handling equipment such as one or more die units, slotters or the like for preparing the web material for use.

It is conventional to provide a single motor-driven line shaft on a flexographic web printing press for driving rotation of the printing units. A gearbox is provided between the line shaft and each unit for driving the plate cylinder, anilox roller and impression cylinder during printing. In addition, the line shaft drives one or more web feed rollers associated with each printing unit to advance the web through the press.

Known flexographic web printing presses are initially set up to handle webs of a predetermined thickness, and are not easily converted to handle webs of a thickness differing substantially from the predetermined one. Because the print length of any particular web substrate is measured at the center line intermediate the opposed surfaces, a thin material requires a shorter web length than a relatively thick material. It is not possible in conventional presses, without significant set up or change over, to adjust the web feed rollers and guide rollers to accommodate such dramatic changes in web thickness. For example, if a press is originally set up to handle relatively thin webs, such as plastic film stock used in the manufacture of labels and the like, it is not possible to easily convert the press for use in printing thick webs such as are used in the production of popcorn boxes or other heavy packaging materials.

OBJECTS AND SUMMARY OF THE INVENTION

It is an object of the present invention to provide a web printing press in which the drive to the printing plates of the printing units is separated from the drive to the web metering system so that the speed at which the web is transported through the press can be adjusted to accommodate webs of various substrate thicknesses, and to allow variable print length adjustment.

It is another object of the present invention to provide a web printing press having a configuration that simplifies pre-registration of the plate cylinders, improves print quality, and facilitates set up and adjustment of the press.

Yet another object of the invention is to provide a printing press having a plurality of printing units that are driven by a single drive motor and line shaft, wherein a single secondary line shaft and drive motor are provided for metering the feed of a web through the printing units independently of the drive provided by the primary line shaft.

In accordance with these and other objects evident from the following description of a preferred embodiment of the invention, a web printing press is provided which includes a frame having a pair of spaced side walls, and at least one printing unit including a plate cylinder, impression cylinder, and web metering roller supported between the side walls for rotation about parallel horizontal axes. A motor-driven primary line shaft is supported on the frame and extends along one of the side walls, and a motor-driven secondary line shaft is provided parallel to the primary shaft. A first gearbox is supported on the frame and is connected between the primary line shaft and the plate cylinder for transmitting rotation of the primary line shaft to the plate cylinder. A second gearbox is supported on the frame and is connected between the primary line shaft and the web metering roller for transmitting rotation of the primary line shaft to the web metering roller. The second gearbox includes gearing connected to the secondary line shaft for trimming the speed of the web metering roller relative to the speed of the primary line shaft upon rotation of the secondary line shaft.

By providing a web printing press in accordance with the present invention, numerous advantages are realized. For example, by providing a press that includes primary and secondary line shafts, a separate gearbox between the primary line shaft and each web metering roller, and gearing for trimming the speed of the web metering roller relative to that of the primary line shaft, it is possible to adjust the speed of the web through the press to accommodate webs of various substrate thicknesses, and to control the print length of the web.

BRIEF DESCRIPTION OF THE DRAWING FIGURES

The preferred embodiment of the present invention is described in detail below with reference to the attached drawing figures, wherein:

FIG. 1 is a schematic end elevational view of a printing unit of a flexographic web printing press constructed in accordance with the preferred embodiment; and FIG. 2 is a side elevational view of the printing unit.

DETAILED DESCRIPTION OF THE PREFERRED EMBODIMENT

Figure 2:
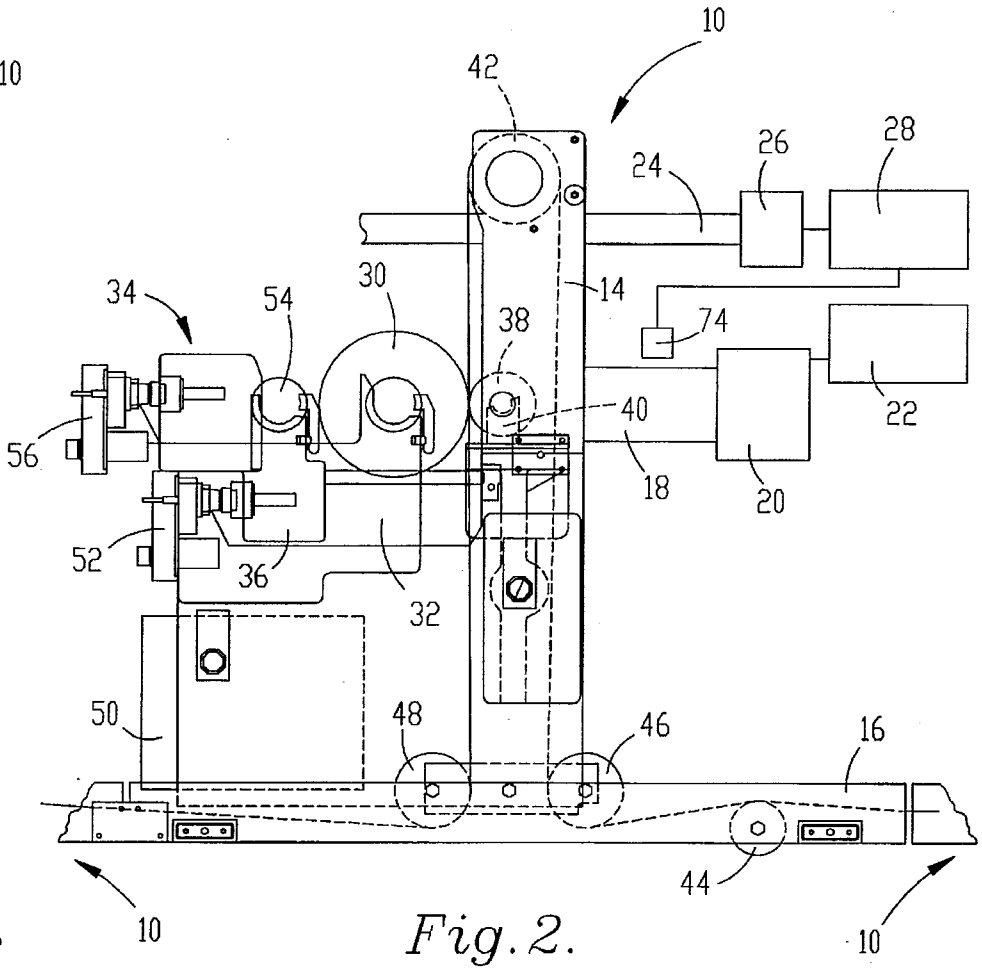

A printing unit 10 of a flexographic web printing press constructed in accordance with the preferred embodiment is illustrated in FIG. 2. The printing press generally includes a conventional web supply, a plurality of the printing units 10 aligned end-to-end, and conventional downstream web handling equipment such as one or more die units, slotters, and the like. In an exemplary embodiment for carrying out four-color printing on the web, four of the printing units are provided. However, it is understood that any number of the units may be employed in any given press.

Figure 1:
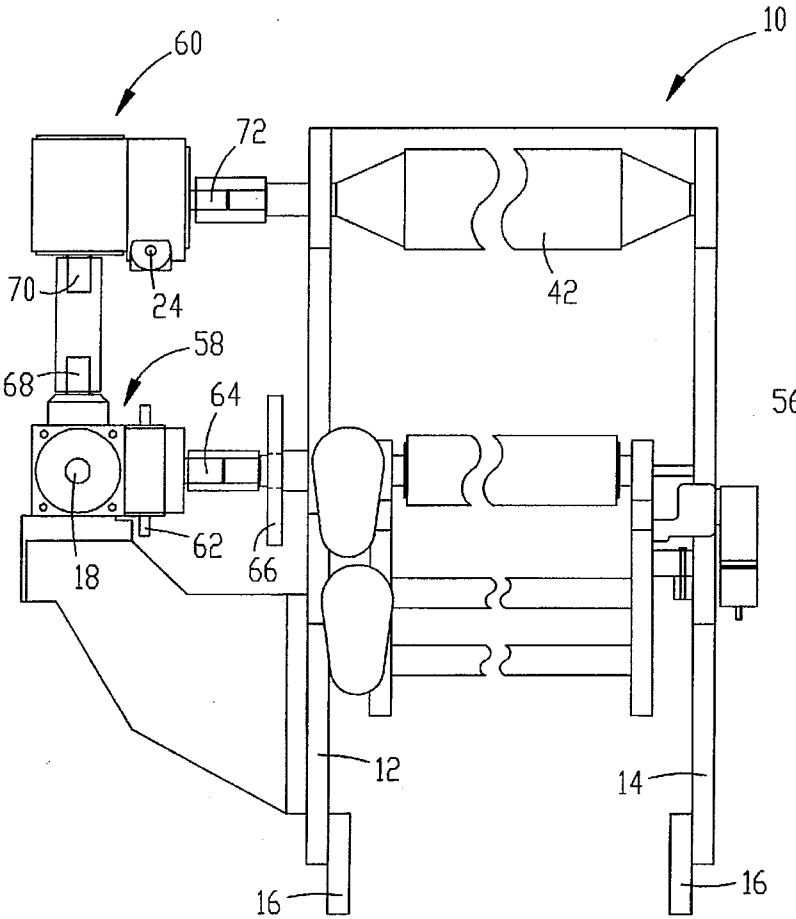

As shown in FIG. 1, the printing press is provided with a frame including a pair of laterally spaced, upstanding side walls 12, 14 that are supported on a base 16. The side walls 12, 14 and base 16 can either be unitary, such that all of the printing units are supported on a common frame, or modular, with each printing unit being supported on an independent frame. In either case, a common press drive is provided for driving all of the printing units in registration with one another.

The press drive is shown in FIG. 2, and includes a primary line shaft 18 supported on the frame and extending along the side wall 12. The shaft 18 is driven by a variable speed DC motor or an AC vector motor 20 or the like that is provided with a controller 22 which permits the press operator to turn the motor on and off and to control the speed of the motor. The primary shaft 18 extends the full length of the press so that all of the printing units are driven by the one shaft.

A secondary line shaft 24 is also supported on the frame and extends along the side wall 12. The secondary shaft is spaced from but parallel to the primary line shaft 18, and is preferably located above the primary line shaft. The secondary line shaft 24 is driven by a servomotor 26, e.g. a brushless AC servomotor, or the like that is provided with a controller 28 which permits the press operator to turn the motor on and off, and for control of the motor speed. The secondary line shaft 24 extends the full length of the press so that the web metering rollers of all of the printing units can be connected to the common secondary shaft in a manner described below.

The printing units are identical to one another, and each unit 10 generally includes a plate cylinder 30 and support assembly 32, an inking cassette 34 and support assembly 36, an impression cylinder 38 and support assembly 40, a web metering roller 42, a plurality of web guide rollers 44, 46, 48, a dryer assembly 50, and a transmission for transmitting rotation of the primary and secondary line shafts 18, 24 to the plate cylinder 30 and the web metering roller 42. The plate cylinder 30 is conventional, and includes a support shaft defining the central longitudinal axis of the cylinder, and an outer circumferential support surface adapted to receive a flexographic printing plate. Although the preferred embodiment is illustrated as a flexographic web printing press, and has particular application to flexographic printing, it is understood that the novel aspects of the invention can also be employed on other types of web printing presses and such uses are contemplated by the present application.

The plate cylinder 30 is mounted for rotation on the support assembly 32 which is, in turn, supported on the frame in such a way that the position of the support assembly 32 and plate cylinder 30 can be adjusted relative to the frame. Specifically, a conventional positioning mechanism 52 is connected between the frame and the support assembly 32 for adjusting the horizontal position of the support assembly along the length of the press in a direction perpendicular to the longitudinal axis of the plate cylinder. Thus, it is possible to adjust the contact position of the nip between the plate cylinder 30 and the impression cylinder 38 to accommodate webs of various substrate thicknesses.

The inking cassette 34 is conventional, and includes an ink reservoir, an anilox roller 54 supported in the reservoir for rotation about the central longitudinal axis of the roller, and a doctor blade or the like for metering the application of ink to the roller. The cassette is secured to the support assembly 36 which is, in turn, supported on the frame in such a way that the position of the support assembly 36 and inking cassette 34 can be adjusted relative to the frame. Specifically, a conventional positioning mechanism 56 is connected between the frame and the support assembly 36 for adjusting the horizontal position of the support assembly along the length of the press in a direction perpendicular to the longitudinal axis of the anilox roller 54. Thus, it is possible to adjust the contact pressure between the anilox roller and the plate cylinder independently of the adjustment made to the plate cylinder support assembly.

The impression cylinder 38 is mounted for rotation on the support assembly 40 which is, in turn, supported on the frame in such a way that the position of the support assembly 40 and impression cylinder 38 can be adjusted relative to the frame. Specifically, the support assembly 40 is mounted in slides or the like which permit the horizontal position of the support assembly and impression cylinder to be adjusted along the length of the press in a direction perpendicular to the longitudinal axis of the impression cylinder. Thus, it is possible to adjust the horizontal position of the printing nip relative to the web metering roller 42, ensuring that the web passes vertically through the nip. Thus, printing is always carried out on a flat substrate.

The longitudinal axes of the plate cylinder 30, impression cylinder 38, and anilox roller 54 are disposed in a common horizontal plane. By providing this construction, it is possible to adjust the pressure between the plate cylinder and the impression cylinder by moving one or both of the cylinders relative to the other within the common horizontal plane. In addition, this configuration facilitates adjustment of the press to accommodate web substrates of various thickness.

The web metering roller 42 is supported between the side walls for rotation about the central longitudinal axis of the roller, which is parallel to the axes of the plate cylinder 30 and impression cylinder 38. The roller 42 presents an outer circumferential surface that is formed of a material suitable for feeding web material through the press, and a vertical web travel path tangent to the outer surface extends through the printing nip when the press is in proper alignment for printing. By spacing the web metering roller 42 above the printing nip, numerous advantages are realized. For example, by extending the web path ahead of the printing unit, additional drying time is provided during which the web is allowed to dry subsequent to a previous printing operation, and it is possible to inspect the web for defects.

In addition, by aligning the metering roller 42 with the printing nip, printing is always carried out on a flat substrate, and it is not necessary to wrap the web around the impression cylinder 38. Thus, it is not necessary to provide a large impression cylinder capable of supporting the web, but a smaller impression cylinder can be employed which provides increased printed dot fidelity.

The guide rollers 44, 46, 48 are each supported between the side walls for rotation about axes that are parallel to the metering roller 42. The rollers 44, 46 are supported along the base of the frame at the upstream end of each unit, and the roller 46 directs the web upward to the metering roller 42 along a vertical path tangent to both rollers. The third guide roller 48 associated with each unit is disposed along the base of the frame at the downstream side of the unit. The web is guided between the rollers 42, 48 along a vertical path through the printing nip.

The dryer assembly 50 associated with each printing unit is conventional, and can take the form of a convection or ultra-violet dryer, or any other known drying means for drying the ink on the web prior to a subsequent printing operation. The dryer is mounted on the frame beneath the printing unit so that the web passes the dryer after leaving the printing nip. In this manner, drying is carried out between each printing operation, and subsequent to the final printing step.

The transmission for transmitting rotation of the primary and secondary line shafts 18, 24 to the plate cylinder 30, anilox roller 54 and web metering roller 42 is shown in FIG. 1, and generally includes a first gearbox 58 supported on the frame and connected between the primary line shaft 18 and the plate cylinder 30 for transmitting rotation of the primary line shaft to the plate cylinder, and a second gearbox 60 supported on the frame and connected between the primary line shaft 18 and the web metering roller 42 for transmitting rotation of the primary line shaft to the web metering roller.

The first gearbox 58 is a conventional gearbox that is supported on the frame by a bracket extending laterally from the side wall 12. The primary line shaft 18 extends through the gearbox 58 and defines the primary input. In addition, planetary phasing gears, including a lineal register correction input shaft 62, are provided for permitting registration changes to be made to the plate cylinder of each printing unit. A first output shaft 64 of the gearbox 58 is connected between the planetary phasing gears and the plate cylinder for driving rotation of the plate cylinder and anilox roller. Preferably, the output shaft 64 is fitted with a helical gear that drives a gear 66 secured to the shaft of the plate cylinder 30. The anilox roller 54, in turn, is driven through a gear connection with the plate cylinder, and the impression cylinder 38 is an idler, being driven through contact with the web and plate cylinder. A second output shaft 68 of the gearbox is connected between the primary line shaft 18 and an input shaft 70 of the second gearbox 60.

The second gearbox is a conventional gearbox, and includes the first input shaft 70 and an output shaft 72 coupled with the web metering roller 42. The secondary line shaft 24 extends through the gearbox and engages planetary phasing gears of the gearbox that are provided between the input and output shafts 70, 72 for trimming the speed of the output shaft relative to the speed of the input shaft. For example, when the secondary shaft 24 remains stationary, rotation of the input shaft 70 is transmitted without phasing to the web metering roller 42. However, if the secondary shaft is rotated in a first direction, rotation of the output shaft 72 is slowed relative to the speed of the input shaft 70, and if the secondary shaft is rotated in a second direction, rotation of the output shaft is accelerated.

As shown in FIG. 2, a conventional encoder 74 is supported on the frame beside the primary line shaft. The encoder measures the speed of rotation of the primary line shaft 18 and generates an output signal indicative of the measured speed. The output signal is supplied to the controller 28 of the servomotor 26 connected to the secondary line shaft 24 so that the rotational speed of the secondary line shaft can be automatically controlled in response to the measured speed of the primary line shaft. The controller 28 includes a conventional input keyboard or the like which permits the operator to input the desired predetermined speed differential or phase relationship between the web metering roller and the plate cylinder so that the predetermined speed differential is maintained automatically between the plate cylinder and the web metering roller during operation of the press.

During set up of the press, the horizontal positions of the impression and plate cylinders 38, 30 are adjusted to accommodate the particular substrate thickness to be printed, and the plate cylinder is preregistered with the web without moving the web, thus significantly reducing start-up waste of expensive material. This results from separating the plate cylinder drive from the web metering drive, and permits 360° print registration can be obtained without affecting web tension. In addition, the operator enters information into the controller 28 for adjusting the web speed relative to the speed of rotation of the plate cylinders to set the desired print length and to adjust the print length to accommodate the particular substrate thickness to be printed. Thereafter, the controller 28 automatically maintains the required web metering roller speed and the desired print length while permitting variable, bi-directional offset by the operator as desired.

Although the present invention has been described with reference to the preferred embodiment, it is noted that equivalents may be employed and substitution made herein without departing from the scope of the invention as recited in the claims.

What is claimed is:

1. A web printing press comprising:

a frame including a pair of spaced side walls;

at least one printing unit including a plate cylinder, an idling impression cylinder, and web metering roller supported between the side walls for rotation about parallel horizontal axes;

a primary line shaft supported on the frame;

a motor for driving rotation of the primary line shaft;

a first gearbox supported on the frame and connected between the primary line shaft and the plate cylinder for transmitting rotation of the primary line shaft to the plate cylinder;

a second gearbox supported on the frame and connected between the primary line shaft and the web metering roller for transmitting rotation of the primary line shaft to the web metering roller;

a secondary line shaft; and a motor for driving rotation of the secondary line shaft, the second gearbox including gearing connected to the secondary line shaft for trimming the speed of the web metering roller relative to the speed of the primary line shaft upon rotation of the secondary line shaft.

2. A web printing press as recited in claim 1, wherein a plurality of printing units are provided, each including:

a plate cylinder, an idling impression cylinder, and web metering roller supported between the side walls of the frame for rotation about parallel horizontal axes;

a first gearbox supported on the frame and connected between the primary line shaft and the plate cylinder for transmitting rotation of the primary line shaft to the plate cylinder;

a second gearbox supported on the frame and connected between the primary line shaft and the web metering roller for transmitting rotation of the primary line shaft to the web metering roller, the second gearbox including gearing connected to the secondary line shaft for trimming the speed of the web metering roller relative to the speed of the primary line shaft upon rotation of the secondary line shaft.

3. A web printing press as recited in claim 1, wherein the plate cylinder and impression cylinder each define a central longitudinal axis, and the longitudinal axes are disposed in a common horizontal plane.

4. A web printing press as recited in claim 3, wherein at least one printing unit includes a mounting means for mounting the impression cylinder on the frame for adjustment within the common horizontal plane toward and away from the plate cylinder.

5. A web printing press as recited in claim 4, wherein the impression cylinder is of a diameter less than the diameter of the plate cylinder.

6. A web printing press as recited in claim 3, wherein the web metering roller is disposed above the impression cylinder, the press further including a web guide roller disposed beneath the plate cylinder so that a vertical web path is defined between the web metering roller and the web guide roller, the path passing between the plate cylinder and the impression cylinder in a direction perpendicular to the common horizontal plane.

7. A web printing press as recited in claim 3, wherein the at least one printing unit further includes an inking assembly for inking the plate cylinder, the inking unit including an ink roller defining a central longitudinal axis disposed in the common horizontal plane.

8. A web printing press as recited in claim 1, further comprising an encoder for measuring the speed of the primary line shaft and for generating a signal indicative of the speed, and a controller for controlling the speed of the secondary line shaft in response to the signal generated by the encoder to maintain a predetermined speed differential between the plate cylinder and the web metering roller.

9. A web printing press as recited in claim 8, wherein the controller includes a means for setting the predetermined speed differential.

* * * * *